US006644379B1

(12) United States Patent
Nei

(10) Patent No.: US 6,644,379 B1
(45) Date of Patent: Nov. 11, 2003

(54) ADJUSTABLE UPPER BEAM WITH A CUTTABLE BLIND ASSEMBLY

(76) Inventor: Shai-Wei Nei, No. 45-4, Fang Bo Tsuen, Fu Shing Hsiang, Changhua Hsien (TW)

( * ) Notice: Subject to any disclaimer, the term of this patent is extended or adjusted under 35 U.S.C. 154(b) by 0 days.

(21) Appl. No.: 10/319,482

(22) Filed: Dec. 16, 2002

(51) Int. Cl.[7] ..... A47G 5/02
(52) U.S. Cl. ..... 160/243
(58) Field of Search ..... 160/243, 133, 160/84.01, 39, 168.1 R, 176.1 R, 178.1 R, 178.1 V, 173 R, 263

(56) References Cited

U.S. PATENT DOCUMENTS 1,301,603 A * 4/1919 Rathbun ..... 160/243
1,949,653 A * 3/1934 Moore ..... 160/168.1 R
2,631,661 A * 3/1953 Nelson ..... 160/243
2,837,152 A * 6/1958 Moore ..... 160/168.1 R
4,603,725 A * 8/1986 Knight ..... 160/133 X
4,699,196 A * 10/1987 Elliott ..... 160/168.1 R
4,742,860 A * 5/1988 Debs ..... 160/178.1 V
5,881,792 A * 3/1999 Cheng ..... 160/263
6,367,537 B1 * 4/2002 Hsu ..... 160/243
6,431,248 B1 * 8/2002 Hyman et al. ..... 160/178.1 R

* cited by examiner

*Primary Examiner*—David Purol
(74) *Attorney, Agent, or Firm*—Troxell Law Office PLLC

(57) ABSTRACT

The adjustable upper beam with a cuttable blind assembly is mainly made up of a blind, a movable upper beam having a telescopic inner tube and outer tube, two retaining clamps, a pull cord wherein the upper side of the blind is held in place by the upwardly and inwardly bent bottom edges of the inner and outer tube of the movable upper beam. The inner and outer tube have a pair of symmetrically protruded registration lugs for registration with the locking holes of the retaining clamps in assembly. The front and rear clamping plates of the retaining clamps can hold the inner and outer tubes firmly in place so as to make the clamping of the retaining clamps against the blind in a firmer manner. The front and rear clamping plates are provided with a hole and a cord seat for the passage and positioning of the pull cord whereby the blind can be adjusted of its size in a DIY manner for fixing to windows of various dimensions.

4 Claims, 5 Drawing Sheets

ADJUSTABLE UPPER BEAM WITH A CUTTABLE BLIND ASSEMBLY

BACKGROUND OF THE INVENTION

The present invention relates to an adjustable upper beam with a cuttable blind assembly. It is mainly made up of a blind embodiment, a movable upper beam having a telescopic inner tube and outer tube, two retaining clamps, a pull cord wherein the upper side of the blind is held in place by the upwardly and inwardly bent retaining edges of the inner and outer tube of the movable upper beam. The inner and outer tube have a pair of symmetrically protruded registration lugs for engagement with the locking holes of the retaining clamps in assembly. The front and rear clamping plates of the retaining clamps made of metallic material can hold the inner and outer tubes firmly in place. The inner tube and outer tube of the movable upper beam are in telescopic engagement with each other so that the length of the upper beam can be adjusted with the blind embodiment cut into size in a DIY manner to fit to windows of various dimensions.

Referring to FIG. 1, the conventional indoor Venetian blind 10 is equipped with a slat assembly 11 of a proper length and width, the slat assembly 11 is provided with a plurality of equally distanced pull cords 12 that are tied to the upper beam 13. Near the two ends of the upper beam 13 are disposed a through hole with a clamping device 14 riveted thereto respectively. Each clamping device 14 has a pivotal hook ring 141 at the joint top end of a front plate 15 and a rear plate 16. The front plate 15 is provided with a cord fixings scat 151 at the bottom thereof, and the rear plate 16 has a through hole at the lower section thereof. A pull cord 17 is led through the cord fixing seat 151 so that the actuation of the pull cord 17 can drive the slat assembly 11 to lift up or roll up gradually.

Such a prior art structure has a disadvantage in practical use. The upper beam 13 of the Venetian blind 10 having a fixed length can only be fit to one size window. A person can not make adjustment on the size of the upper beam 13 to make the same adapted to windows of different sizes.

SUMMARY OF THE INVENTION

Therefore, the primary object of the present invention is to provide a length adjustable upper beam with cuttable blind embodiment so that the Venetian blind can be fitly mounted to windows of various sizes in a DIY manner.

Another object of the present invention is to provide a length adjustable upper beam holding the blind assembly in place by way of retaining clamps having proper flexibility and stiffness so that they can effectively and tightly hold the outer tube and the inner tube.

DETAILED DESCRIPTION OF THE PREFERRED EMBODIMENT

Figure 1:
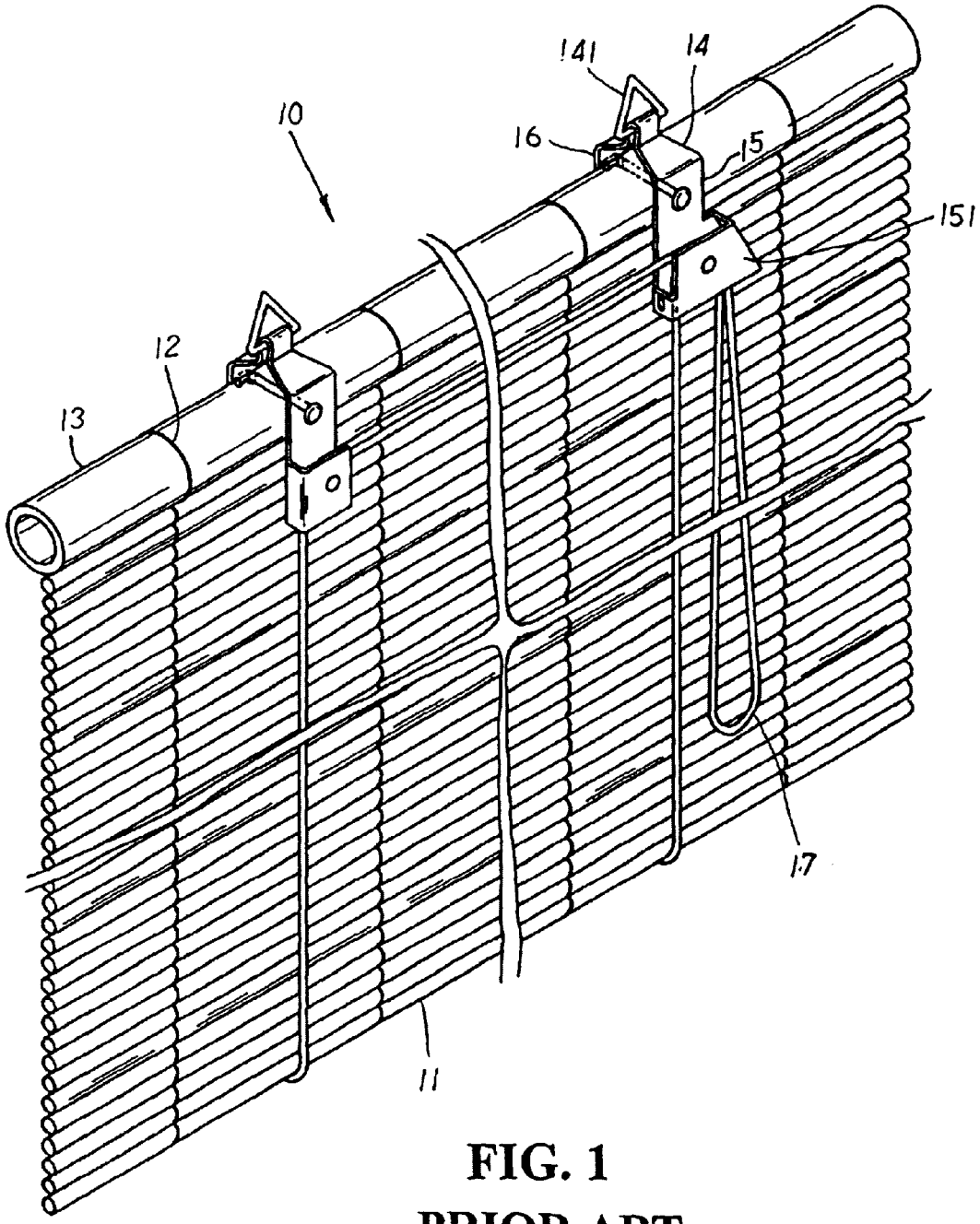
FIG. 1 PRIOR ART
FIG. 1 is a perspective diagram showing the prior art structure.
Figure 2:
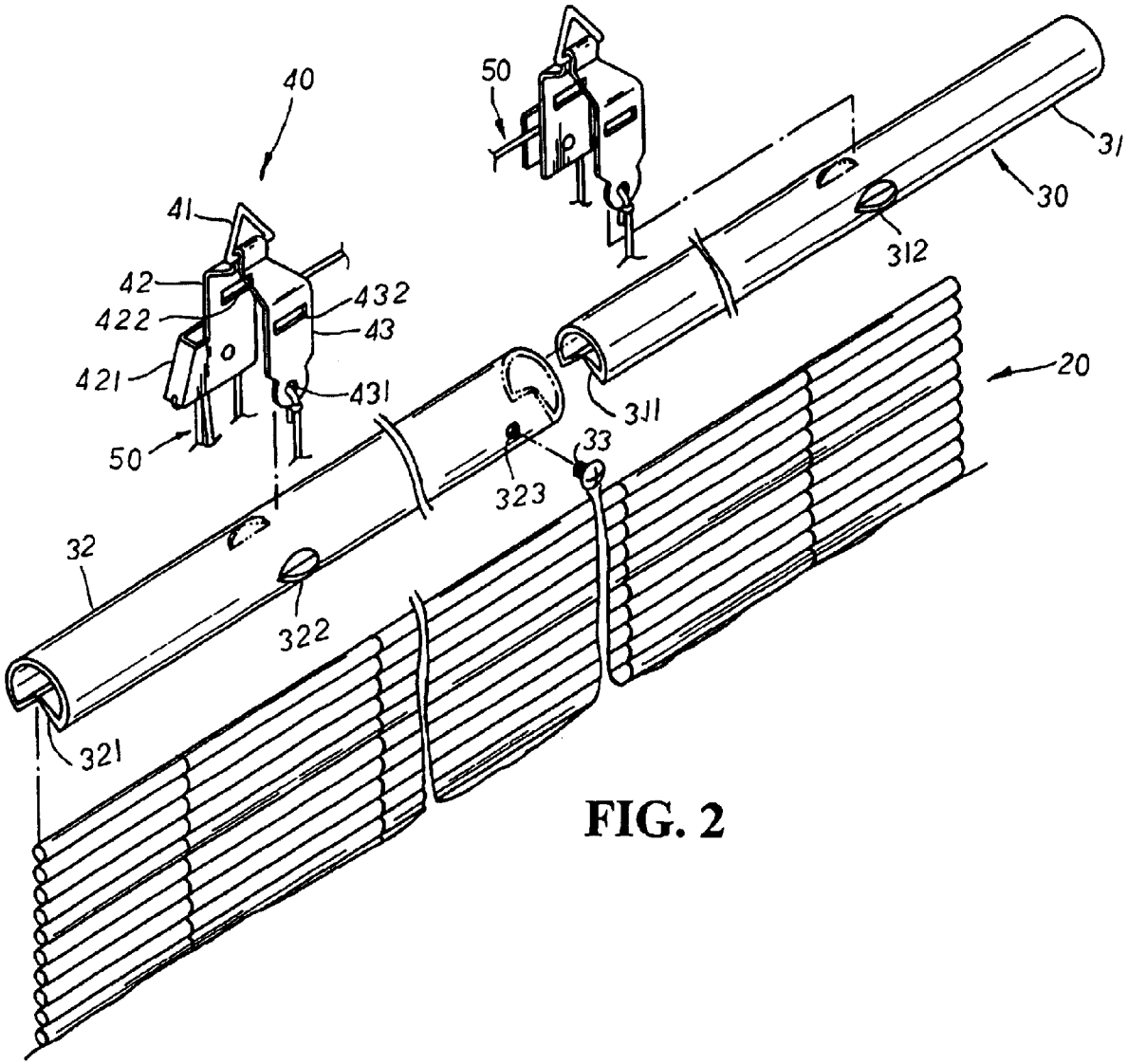
FIG. 2 is a perspective diagram showing the exploded components of the present invention.

Referring to FIG. 2, the present invention of the adjustable upper beam with a cuttable Venetian blind assembly mainly comprises a blind embodiment 20, a movable upper beam 30, a pair of retaining clamps 40, and a pull cord 50 wherein the blind embodiment 20 of a proper length and width is removably attached to the underside of the movable upper beam 30. The movable upper beam 30 includes an inner tube 31 and an outer tube 32 that are partially in telescopic engagement with each other and respectively have inwardly and upwardly bent bottom edges that are flexibly in tight contact with each other. On the outer surface of both the inner and outer tubes 31, 32 are disposed a pair of symmetric protruded registration lugs 312, 322. The outer tube 32 has a through hole 323 and a screw 33 to act as a locking means for retaining the inner tube 31 in place which is telescopically adjustable in the outer tube 32.

Each retaining clamp 40 made of metal with proper flexibility and stiffness has a suspension hood 41 at the top thereof and a front clamping plate 42 and a rear clamping plate 43 that are integrally connected to each other as a whole. The rear clamping plate 43 has a through hole 431 at the bottom thereof for the passage and tying up of the pull cord 50; and the front clamping plate 42 has a pulley seat 421 for the passage and operation of the pull cord 50. The front clamping plate 42 and the rear clamping plate 43 of each retaining clamp 40 have a locking hole 422 and 432 respectively that are in registration with the protruded registration lugs 312, 322 of the inner tube 30 and the outer tube 32 in assembly.

The upper beam of the present invention is characterized by that the movable upper beam 30 has an outer tube 32 and an inner tube 31 that are partially telescopically engaged with each other. The outer tube 32 and inner tube 31 have a pair of inwardly and upwardly bent bottom edges 321 and 311 respectively that are flexibly in contact with each other so as to permit the blind assembly to be tightly fit in for suspension.

On the outer surface of the outer tube 32 and the inner tube 31 are respectively disposed a pair of symmetrically protruded registration lugs 322, 312. The outer tube 32 has a locking means, in this instance including a screw hole 323 on the surface thereof and a locking screw 33, for adjustably locking the telescopically engaged inner tube 31 in place.

The distance between the front clamping plate 42 and the rear clamping plate 43 of the retaining clamp 40 is smaller than the diameters of both the outer tube 32 and the inner tube 31 so that the retaining clamps 40 can hold the upper beam in a firmer manner.

Moreover, both the movable upper beam 30 and the retaining clamps 40 are made of metal so that they have proper stiffness and flexibility for firmly holding the blind embodiment 20 and the inner tube 31 and the outer tube 32 in assembly.

Figure 3:
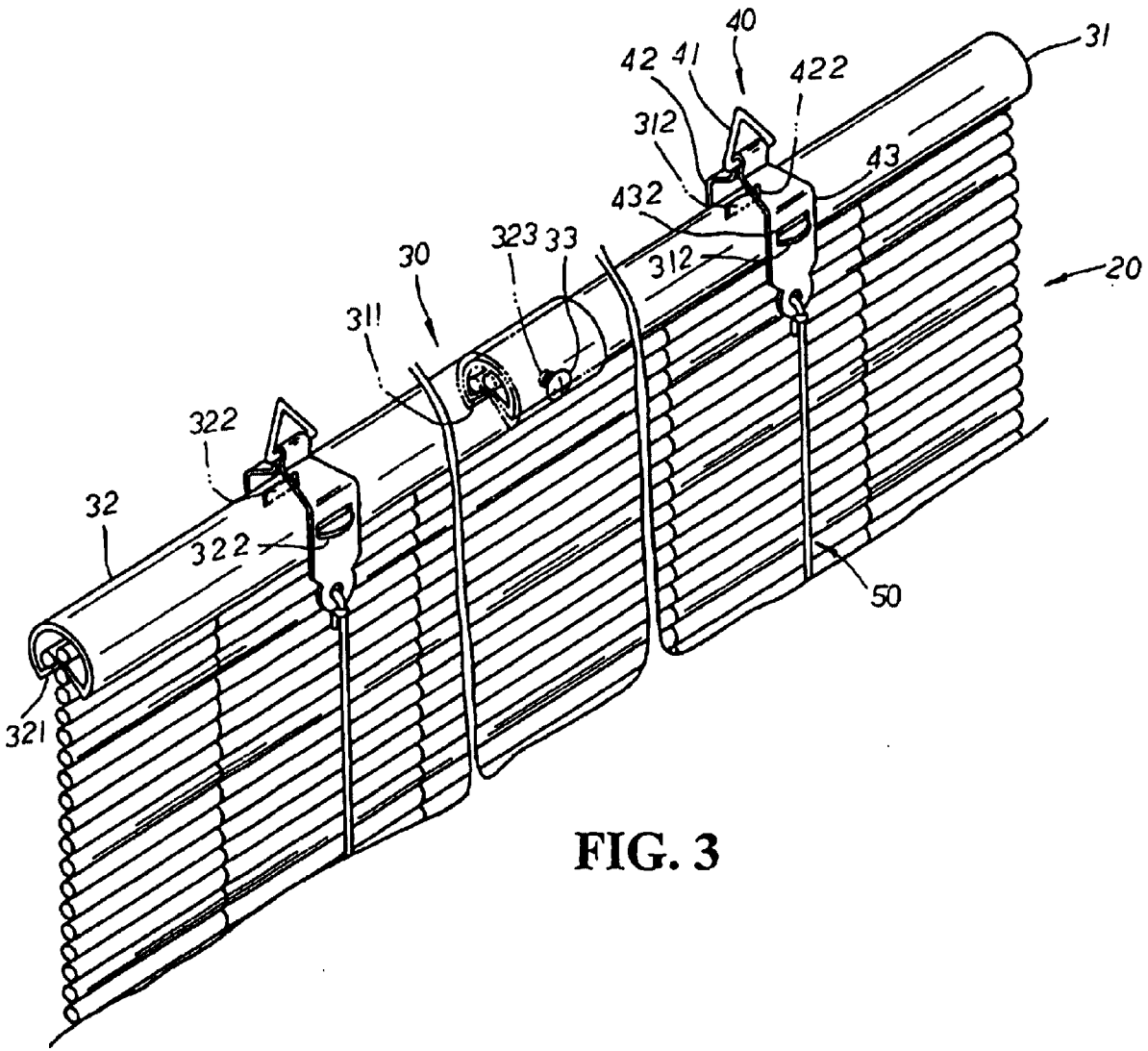
FIG. 3 is a perspective diagram showing the assembly of the present invention.

In assembly, as shown in FIG. 3, the inner tube 31 and the outer tube 32 are telescopically engaged with each other to form an upper beam 30 first and then the upper section of the blind embodiment 20 is partially forced into the inner tube 31 and outer tube 32 via the inwardly and upwardly bent bottom edges 311 and 321 of the same. Next, the two retaining clamps 40 are downwardly forced into engagement with the inner tube 31 and the outer tube 32 with the front clamping plate 42 and the rear clamping plate 43 tightly holding the inner tube 31 and the outer tube 32 in place. As a result, the locking holes 422, 432 are forced into registration with the protruded registration lugs 312 and 322 of the inner tube 31 and outer tube 32.

Figure 4:
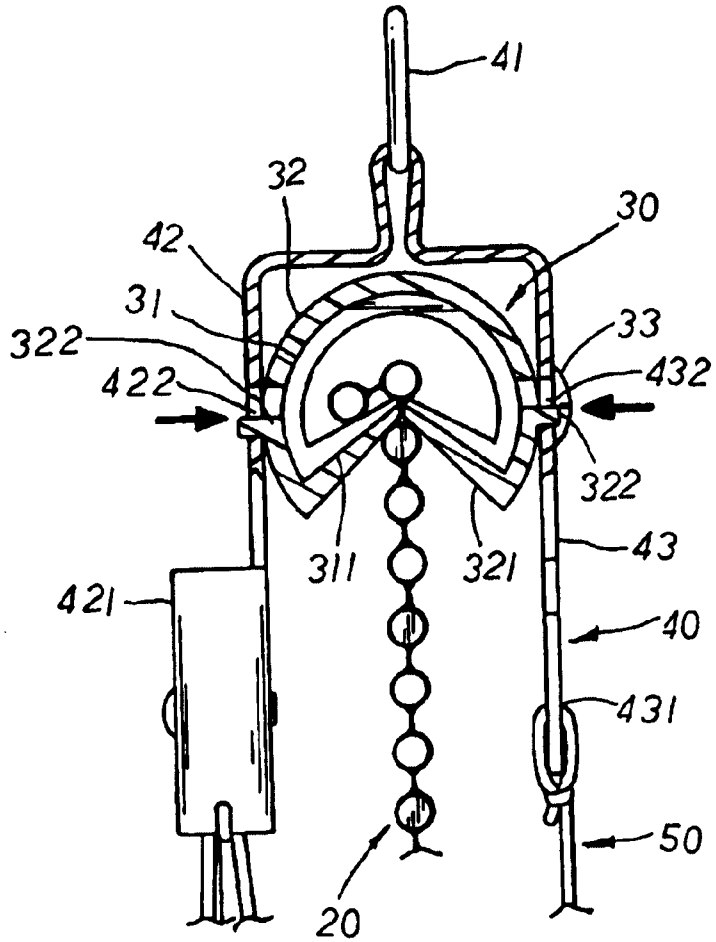
FIG. 4 is a sectional diagram of the assembly of the present invention.

Referring to FIG. 4, the inner tube 31 can be locked in place with respect to the outer tube 32 by the screw 33 led through the screw hole 323. Then the pull cord 50 is led through the pulley seat 421 and the through hole 431 and further tied up in place by a knot so as to permit the blind 11 to be rolled up or lifted up step by step.

Figure 5:
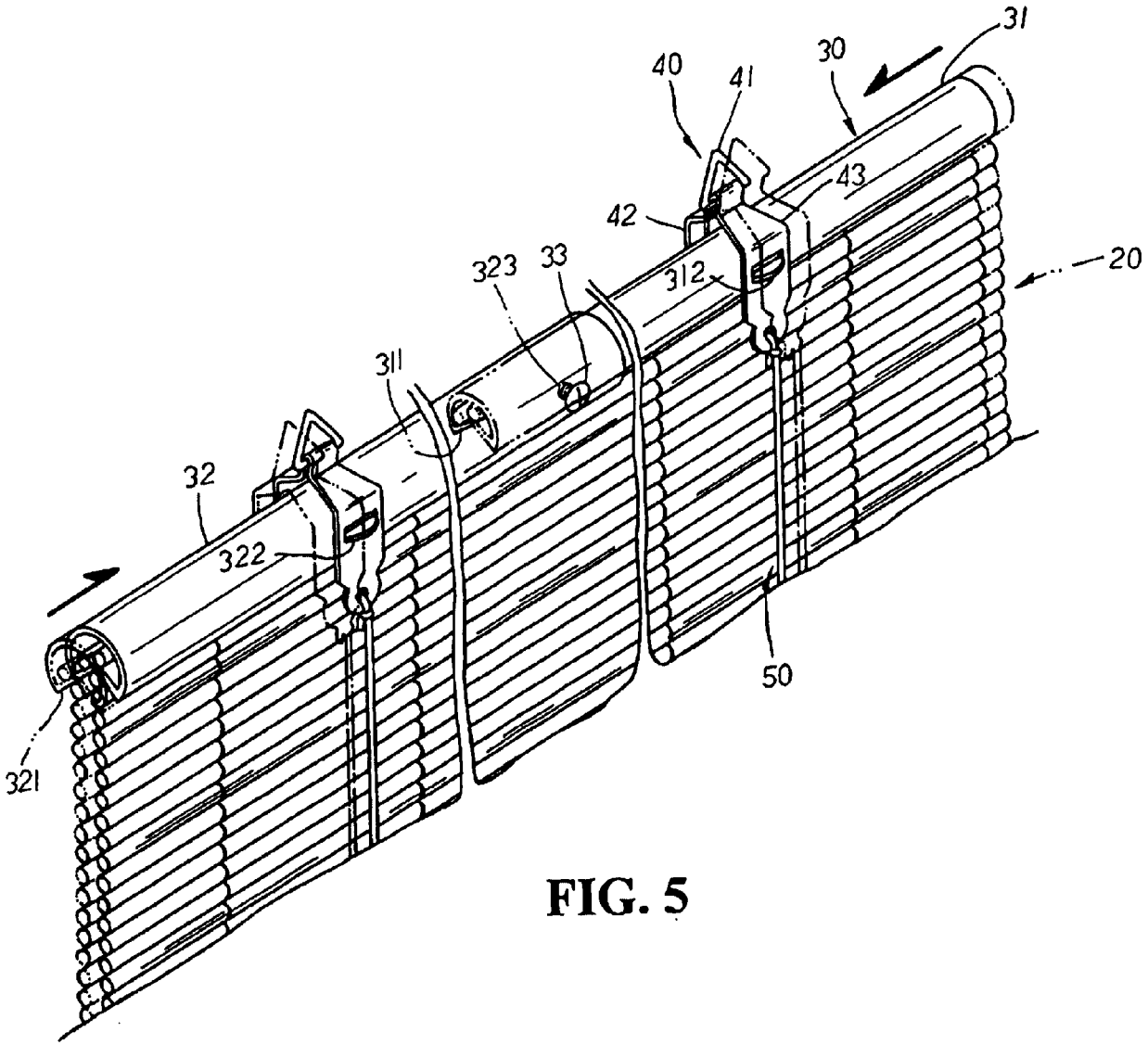
FIG. 5 is a diagram showing the adjustment operation of the present invention.

Once the blind embodiment 20 is not fit to a window bracket, as shown in FIG. 5, the screw 33 is first released and let the inner tube 31 and the outer tube 32 to be telescopically adjusted to obtain a proper length and then the screw 33 in the screw hole 323 is tightened up to hold the inner tube 31 in place. Afterwards, the outfit blind embodiment 20 with respect to the upper beam 30 is trimmed or cut into size by scissors or knife in a DIY manner with ease.

What is claimed is:

1. An adjustable upper beam with a cuttable blind assembly, comprising:

a blind embodiment, a movable upper beam; a pair of retaining clamps; and a pull cord;

wherein said blind embodiment is removably attached to an underside of said movable beam and each said retaining clamp has a suspension hook disposed at a top end thereof and has a front clamping plate and a read clamping plate that are integrally connected to each other; said front clamping plate have a pulley seat for the passage and operation of said pull cord; and said rear clamping plate has a through hole at the bottom thereof for the passage trying up of said pull cord;

wherein said upper beam is characterized by that said movable upper beam has an outer tube and an inner tube that are partially telescopically engaged with each other; said outer tube and inner tube have a pair of inwardly and upwardly bent bottom edges that are flexibly in contact with each other; on an outer surface of said outer tube and said inner tube are respectively disposed a pair of symmetrically placed registration lugs that are in registration with locking holes defined on said front and rear clamping plates of said retaining clamps; said outer tube has a locking means for adjustably locking said telescopically engaged inner tube in place.

2. The adjustable upper beam with cuttable blind assembly as claimed in claim 1 wherein locking means of said outer tube comprises a through hole on said outer tube and a screw for locking said inner tube of said telescopic inner tube in place with said outer tube.

3. The adjustable upper beam with a cuttable blind assembly as claimed in claim 1 wherein the distance between said front clamping plate and said rear clamping plate of each said retaining clamp is smaller than the diameters of both said outer tube and said inner tube so that said retaining clamps can hold said upper beam in a firm manner.

4. The adjustable upper beam with a cuttable blind assembly as claimed in claim 1 wherein said movable upper beam and said retaining clamps are made of metal with stiffness and flexibility.

* * * * *